US011217069B1

(12) United States Patent
Kim et al.

(10) Patent No.: US 11,217,069 B1
(45) Date of Patent: Jan. 4, 2022

(54) AUTOMATED TELLER MACHINE

(71) Applicant: HYOSUNG TNS INC., Seoul (KR)

(72) Inventors: Dong Kyung Kim, Gyeonggi-do (KR); Kyoung Soo Kim, Gyeonggi-do (KR); Seok Won Kim, Gyeonggi-do (KR); Seung Soo Lee, Gyeonggi-do (KR)

(73) Assignee: HYOSUNG TNS INC., Seoul (KR)

( * ) Notice: Subject to any disclaimer, the term of this patent is extended or adjusted under 35 U.S.C. 154(b) by 0 days.

(21) Appl. No.: 16/903,417

(22) Filed: Jun. 17, 2020

(51) Int. Cl.
*G07F 19/00* (2006.01)
*G07D 11/40* (2019.01)
*G07D 11/165* (2019.01)

(52) U.S. Cl.
CPC ..... *G07F 19/202* (2013.01); *G07D 11/165* (2019.01); *G07D 11/40* (2019.01); *G07F 19/205* (2013.01)

(58) Field of Classification Search
CPC ..... G06F 19/202; G06F 19/205; G07D 11/00; G07D 11/14; G07D 11/40; G07D 11/165
See application file for complete search history.

(56) References Cited

U.S. PATENT DOCUMENTS

2002/0003163 A1* 1/2002 Peebles ..... G07D 11/14 235/379
2009/0166957 A1* 7/2009 Kong ..... B65H 31/3027 271/198
2017/0073100 A1* 3/2017 Nagase ..... B65B 57/04
2018/0290849 A1* 10/2018 Hosokawa ..... B65H 5/062

FOREIGN PATENT DOCUMENTS

EP 3379504 * 9/2018
KR 10-2019-0041603 6/2020

* cited by examiner

*Primary Examiner* — Laura A Gudorf
(74) *Attorney, Agent, or Firm* — Bacon & Thomas, PLLC

(57) ABSTRACT

An automated teller machine includes: a main body; a deposit/withdrawal unit provided at one side in the main body and configured to separate and stack a medium; a customer service unit serving to receive the medium from or deliver the medium to a user; a tray unit configured to transfer the medium between the deposit/withdrawal unit and the customer service unit while reciprocating therebetween; and a bill stopper rotatably provided at an entrance of the deposit/withdrawal unit through which the tray unit passes to open and close the entrance of the deposit/withdrawal unit. The deposit/withdrawal unit includes: a housing; a separating/stacking module disposed in the housing to separate and stack the medium; and an opening/closing module rotatably provided at one side of the housing to allow the separating/stacking module to be exposed to the outside of the housing, the bill stopper being rotatably installed at the opening/closing module.

3 Claims, 3 Drawing Sheets

AUTOMATED TELLER MACHINE

FIELD OF THE INVENTION

The present disclosure relates to an automated teller machine.

BACKGROUND OF THE INVENTION

Generally, an automated teller machine (ATM) provides financial services such as deposit and withdrawal of cash and check using a card or a passbook without a bank employee regardless of time and place.

Recently, the ATM is widely used not only in financial institutions such as banks but also in convenience stores, department stores, and public places. The ATM may be classified into a withdrawal machine, a deposit machine, and a deposit and withdrawal machine depending on whether a transaction is a deposit or a withdrawal. Recently, the ATM is variously used for cash deposit/withdrawal, check deposit/withdrawal, passbook update, electronic bill payment, ticket sales, and the like.

A conventional ATM can be classified into two types depending on an insertion type of a medium such as cash or check. One is a pocket type in which a deposit/withdrawal unit has a pocket shape and allows a user to insert a medium into a pocket. The other one is a present type in which a bill is inserted or withdrawn through a slot formed at the deposit/withdrawal unit. In the case of the pocket type, a user needs to insert a hand into the pocket to insert a medium for deposit. However, depending on a user's culture, a user often minds putting a part of a body into a machine. Therefore, the present type in which a user can deposit/withdraw a medium without inserting a hand into the deposit/withdrawal unit can be applied as a solution to the problem of the pocket type. However, the present type is disadvantageous in that it is weak in security and the number of media that can be deposited/withdrawn at one time is limited. Thus, a user who wants to deposit/withdraw a large amount of media at one time feels uncomfortable.

Although there have been attempts to combine the pocket type and the present type to solve the problems of the two types (see, e.g., Korean Patent Application Publication No. 10-2014-0077439), it is still far from practical application due to a complicated structure and lack of practicality. Therefore, there is a demand for research on a deposit/withdrawal unit having an innovative structure capable of solving the problems of the pocket type and the present type.

SUMMARY OF THE INVENTION

In view of the above, the present disclosure provides an automated teller machine (ATM) capable of easily removing a medium jammed in a deposit/withdrawal unit while solving the problems of the pocket type and the present type.

In accordance with an embodiment of the present disclosure, there is provided an automated teller machine including: a main body; a deposit/withdrawal unit provided at one side in the main body and configured to separate and stack a medium; a customer service unit provided at a front side of the main body, the customer service unit serving to receive the medium from or deliver the medium to a user; a tray unit configured to transfer the medium between the deposit/withdrawal unit and the customer service unit while reciprocating therebetween; and a bill stopper rotatably provided at an entrance of the deposit/withdrawal unit through which the tray unit passes to open and close the entrance of the deposit/withdrawal unit, wherein the deposit/withdrawal unit includes: a housing; a separating/stacking module disposed in the housing to separate and stack the medium; and an opening/closing module rotatably provided at one side of the housing to allow the separating/stacking module to be exposed to the outside of the housing, the bill stopper being rotatably installed at the opening/closing module.

The deposit/withdrawal unit may further include a hinge part provided at one side of the housing to connect the opening/closing module to the housing to be rotatable.

The opening/closing module may be configured to be upwardly rotated about the hinge part so that the opening/closing module is positioned on an upper side of the housing to open the entrance of the deposit/withdrawal unit.

The opening/closing module may further include a stopper hinge which rotatbly connects the bill stopper to the opening/closing module.

The deposit/withdrawal unit may further include a lifting module provided at the housing to move the tray unit inserted in the housing in a vertical direction.

Effect of the Invention

In accordance with the embodiment of the present disclosure, the problems of the pocket type and the present type can be solved and when a medium is jammed in the deposit/withdrawal unit, the jammed medium can be easily removed by partially opening the deposit/withdrawal unit.

BRIEF DESCRIPTION OF THE DRAWINGS

The objects and features of the present disclosure will become apparent from the following description of embodiments, given in conjunction with the accompanying drawings, in which.

DETAILED DESCRIPTION OF THE EMBODIMENTS

Figure 1:
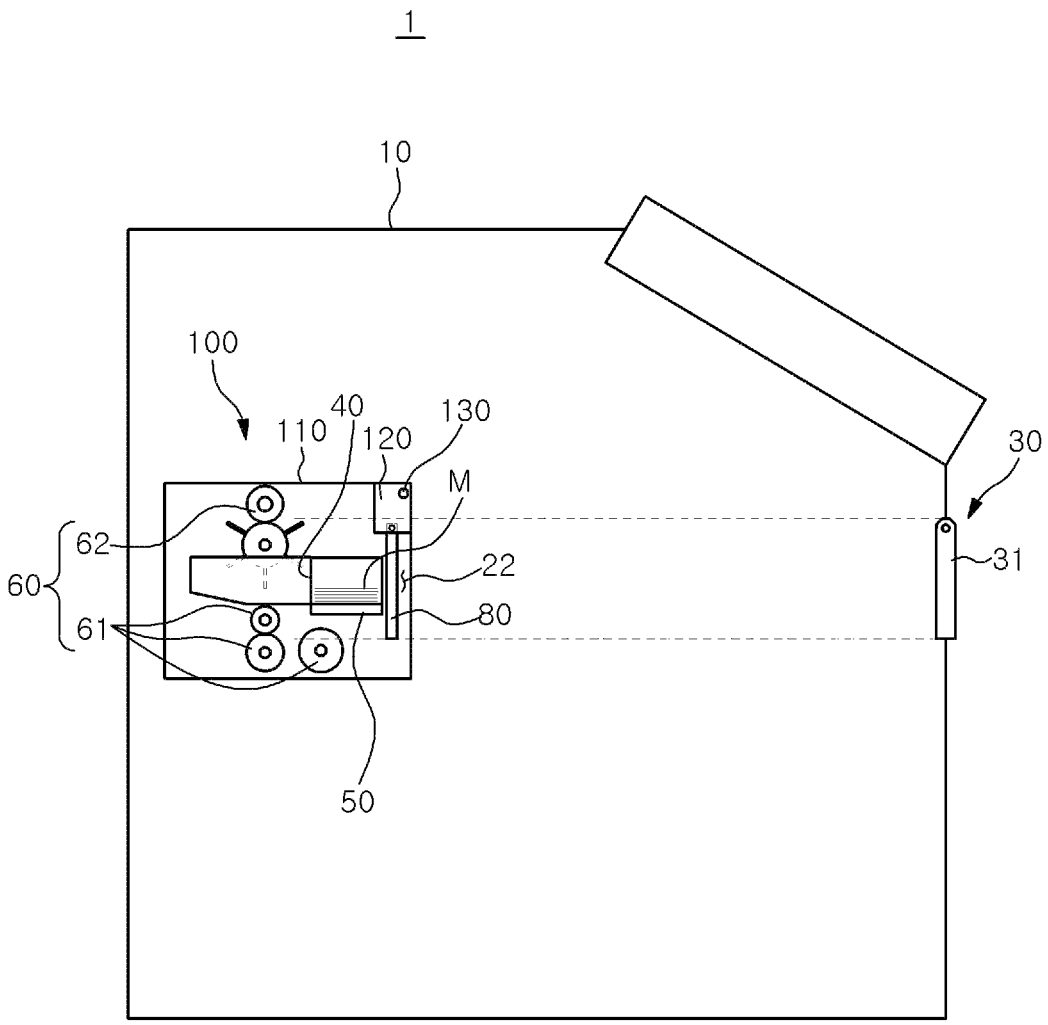
FIG. 1 is a conceptual diagram of an automated teller machine (ATM) according to an embodiment of the present disclosure.

Hereinafter, configurations and operations of embodiments will be described in detail with reference to the accompanying drawings. The following description is one of various patentable aspects of the disclosure and may form a part of the detailed description of the disclosure.

In describing the embodiments of the present disclosure, the detailed descriptions of well-known functions or configurations will be omitted if it is determined that the detailed descriptions of well-known functions or configurations may unnecessarily make obscure the spirit of the present disclosure.

The disclosure may be variously modified and may include various embodiments. Specific embodiments will be exemplarily illustrated in the drawings and described in the detailed description of the embodiments. However, it should be understood that they are not intended to limit the disclosure to specific embodiments but rather to cover all modifications, similarities, and alternatives which are included in the spirit and scope of the disclosure.

The terms used herein, including ordinal numbers such as "first" and "second" may be used to describe, and not to limit, various components. The terms simply distinguish the components from one another.

When it is said that a component is "coupled" or "linked" to another component, it should be understood that the former component may be directly connected or linked to the latter component or a third component may be interposed between the two components.

Specific terms used in the present application are used simply to describe specific embodiments without limiting the disclosure. An expression used in the singular encompasses the expression of the plural, unless it has a clearly different meaning in the context.

Hereinafter, an embodiment of the present disclosure will be described in detail with reference to the accompanying drawings.

Referring to FIG. 1, an automated teller machine (ATM) 1 according to an embodiment of the present disclosure may include a main body 10, a deposit/withdrawal unit 100, a customer service unit 30, a tray unit 40 and a bill stopper 80.

The main body 10 forms an outer shape of the ATM 1, and can accommodate therein the deposit/withdrawal unit 100, the customer service unit 30, the tray unit 40 and the like.

The deposit/withdrawal unit 100 is provided at one side in the main body 10, and can separate and stack media M to be deposited/withdrawn. The deposit/withdrawal unit 100 may include a housing 110, a lifting module 50 and a separating/stacking module 60.

The housing 110 may be provided in the main body 10 and may have an accommodation space for accommodating the components of the deposit/withdrawal unit 100. Further, the housing 110 may be provided with an entrance 22 of the deposit/withdrawal unit 100 through which the tray unit 40 to be described later can pass.

The separating/stacking module 60 may be disposed in the housing 110. The separating/stacking module 60 may include a separating roller 61 and a stacking roller 62.

The separating roller 61 may be provided to separate media M transferred by the tray unit 40, and may be disposed at a lower side in the housing 110.

The separating roller 61 may separate the media M stored in the tray unit 40 one by one and transfer the media M along a transfer path. The stacking roller 62 may be provided to stack a rejected medium M or a medium M to be withdrawn among the media M separated by the separating roller 61 in the tray unit 40. The tacking roller 62 may be disposed at an upper side in the housing 110.

The lifting module 50 is provided in the housing 110 to selectively move the tray unit 40 inserted into the deposit/withdrawal unit 100 in a vertical direction. Due to the vertical movement, the media M stacked in the tray unit 40 can be transferred along the transfer path in the main body 10, or the media M in the main body 10 can be transferred to a position where the media M can be stacked in the tray unit 40.

In other words, when the tray unit 40 is lowered by the lifting module 50, the tray unit 40 is overlapped with the separating roller 61 in the vertical direction and the media M stacked in the tray unit 40 can be separated and stored along the transfer path in the main body 10 by the operation of the separating roller 61. At this time, the state in which the tray unit 40 is lowered and overlapped with the separating roller 61 may be referred to as "separation mode."

On the other hand, when the tray unit 40 is lifted by the lifting module 50, the media M can be inserted into and stacked in the tray unit 40 by the operation of the stacking roller 62. In that case, the medium M can be stacked in the tray unit 40 by the stacking roller 62 in order to transfer a rejected medium M among the media M separated by the separating roller 61 or withdraw a medium M stored in a cassette (not shown) in the main body 10. The state in which the tray unit 40 is lifted and the medium M is being inserted into the tray unit 40 by the stacking roller 62 may be referred to as "stacking mode."

The customer service unit 30 may be provided through which a user (customer) can deposit or withdraw media M such as bills or checks, and may be provided at a front side of the main body 10 to facilitate deposit or withdrawal. The customer service unit 30 serves to receive or deliver a medium from or to a user. The customer service unit 30 may be provided with a deposit/withdrawal shutter 31 which is opened and closed by a control signal so that a medium can be inserted into or discharged from the ATM 1 while the deposit/withdrawal shutter 31 is opened.

Meanwhile, the tray unit 40 reciprocates from the customer service unit 30 to the inside of the deposit/withdrawal unit 100 to transfer the media M stored therein to the deposit/withdrawal unit 100 or the customer service unit 30. In other words, the tray unit 40 can receive a medium M from a customer at the customer service unit 30 and move to the deposit/withdrawal unit 100 to separate and store the media M. Further, the tray unit 40 can receive a withdrawal target media M from the deposit/withdrawal unit 100 and move to the customer service unit 30 to deliver the media M to a customer.

As described above, the tray unit 40 can be inserted into or taken out from the housing 110 through the entrance 22 of the deposit/withdrawal unit 100. The tray unit 40 inserted into the housing 110 can be mounted on the lifting module 50.

The bill stopper 80 is rotatably provided at the deposit/withdrawal unit 100, and can be rotated to open and close the entrance 22 of the deposit/withdrawal unit 100, if necessary. The bill stopper 80 is opened when the tray unit 40 is taken out from the deposit/withdrawal unit 100. The bill stopper 80 is closed when the tray unit 40 has been inserted into the deposit/withdrawal unit 100. Accordingly, when the medium M is inserted and stacked into the tray unit 40 by the operation of the stacking roller 62, the medium M collides with an inner surface of the closed bill stopper 80 and then can be stacked in the tray unit 40. After the medium M is stacked in the tray unit 40, the tray unit 40 may be drawn out of the deposit/withdrawal unit 100 and moved toward the customer service unit 30.

According to the embodiment of the present disclosure, there is provided a structure with which when a medium M is jammed while the deposit/withdrawal unit 100 performs the separation mode or the stacking mode, the separating/stacking module 60 in the deposit/withdrawal unit 100 is easily exposed to the outside of the deposit/withdrawal unit 100 so that a user can readily remove the jammed medium M.

In order to provide the above structure, the deposit/withdrawal unit 100 may further include an opening/closing module 120 which is rotatably provided at the housing 110.

As described above, the separating/stacking module 60 is disposed in the housing 110.

The opening/closing module 120 has a configuration which allows the separating/stacking module 60 to be exposed to the outside when a medium M is jammed in the separating/stacking module 60 disposed in the housing 110. The opening/closing module 120 is provided at one side of the housing 110 to be rotatable upwardly.

The bill stopper 80 is rotatably installed at the opening/closing module 120. For this purpose, the opening/closing module 120 may include a stopper hinge 81 which connects the bill stopper 80 to the opening/closing module 120 to be rotatable. Thus, the bill stopper 80 can be rotated with respect to the opening/closing module 120 about the stopper hinge 81.

Figure 2:
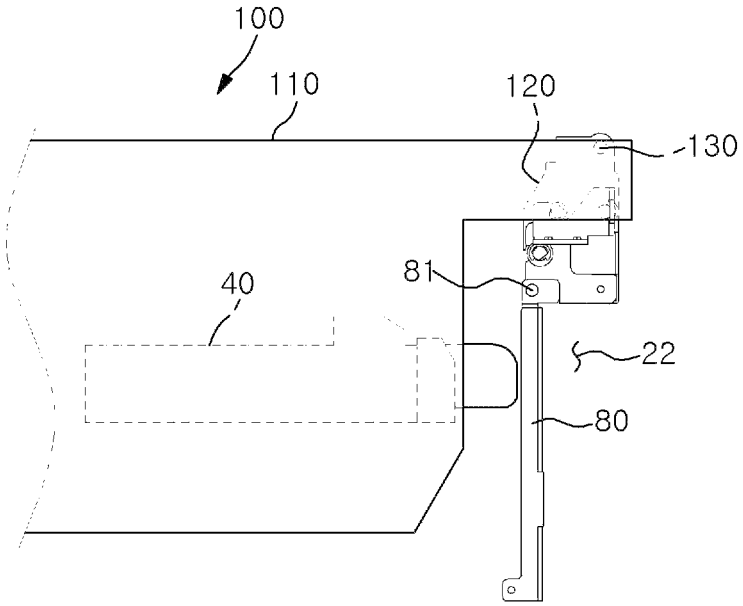
FIG. 2 is an enlarged side view of a deposit/withdrawal unit of the ATM shown in FIG. 1.

As shown in FIG. 2, the bill stopper 80 is vertically extended from the opening/closing module 120 in the state where the tray unit 40 is inserted in the deposit/withdrawal unit 100 to close the entrance 22 of the deposit/withdrawal unit 100. In this case, the opening/closing module 120 is in a closing state in which one side of the housing 110 is closed by the opening/closing module 120 so that the separating/stacking module 60 is not exposed to the outside.

Figure 3:
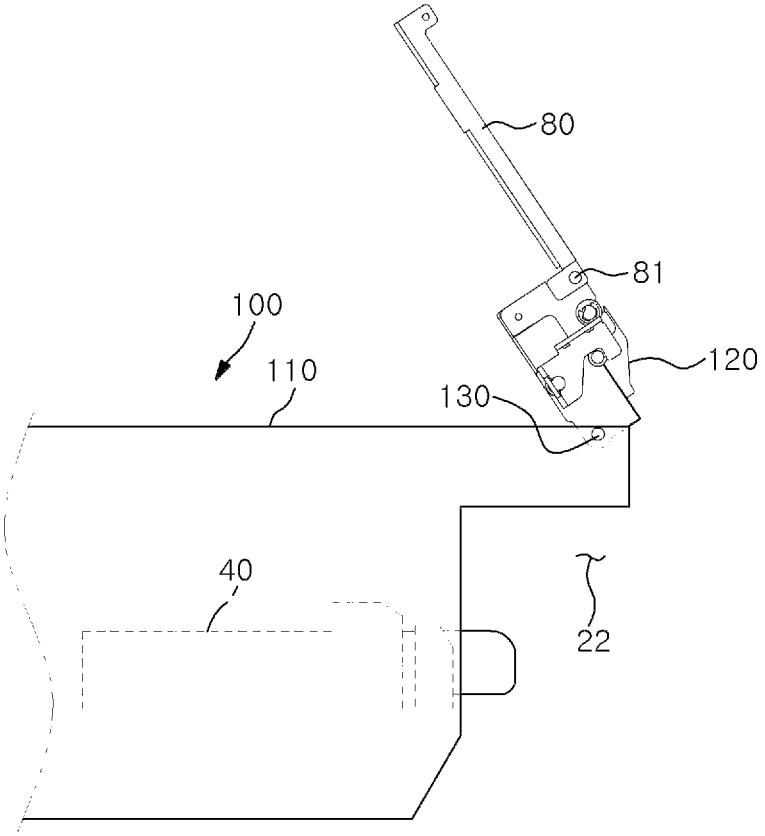
FIG. 3 shows a state in which an opening/closing module of the deposit/withdrawal unit in FIG. 2 is rotated upwardly.

In the normal operation state of the deposit/withdrawal unit 100, if a medium M is jammed on the transfer path, the opening/closing module 120 is upwardly rotated to the upper side of the housing 110 to allow the separating/stacking module 60 in the housing 110 to be exposed to the outside of the housing 110, as shown in FIG. 3. Accordingly, a user can readily remove the jammed medium M through the opening of the housing 110 opened by the opening/closing module 120. At this time, the bill stopper 80 can be moved to the upper side of the housing 110 along with the opening/closing module 120.

The deposit/withdrawal unit 100 may further include a hinge part 130.

The hinge part 130 is provided at one side of the housing 110 as shown in FIGS. 2 and 3 to connect the opening/closing module 120 to the housing 110 to be rotatable, and the opening/closing module 120 can be rotated up and down about the hinge part 130 provided at one side of the housing 110.

When the opening/closing module 120 is upwardly rotated about the hinge part 130, one side of the housing 110 is opened to expose the separating/stacking module 60 to the outside. Further, when the opening/closing module 120 is rotated downwards about the hinge part 130, one side of the housing 110 is closed and the normal separation or stacking operation of the deposit/withdrawal unit 100 can be performed. When the opening/closing module 120 is upwardly rotated, the opening/closing module 120 may be configured to be positioned on the upper side of the housing 110.

While the present disclosure has been shown and described with respect to the embodiments, it will be understood by those skilled in the art that various changes and modifications may be made without departing from the scope of the present disclosure as defined in the following claims.

What is claimed is:

1. An automated teller machine, comprising:

a main body;

a deposit/withdrawal unit provided at one side in the main body and configured to separate and stack a medium;

a customer service unit provided at a front side of the main body, the customer service unit serving to receive the medium from or deliver the medium to a user;

a tray unit configured to transfer the medium between the deposit/withdrawal unit and the customer service unit while reciprocating therebetween; and a bill stopper rotatably provided at an entrance of the deposit/withdrawal unit through which the tray unit passes to open and close the entrance of the deposit/withdrawal unit, wherein the deposit/withdrawal unit includes:

a housing;

a separating/stacking module disposed in the housing to separate and stack the medium; and an opening/closing module rotatably provided at one side of the housing to allow the separating/stacking module to be exposed to the outside of the housing, the bill stopper being rotatably installed at the opening/closing module, wherein the deposit/withdrawal unit further includes a hinge part provided at one side of the housing to connect the opening/closing module to the housing to be rotatable, and wherein the opening/closing module further includes a stopper hinge which rotatably connects the bill stopper to the opening/closing module.

2. The automated teller machine of claim 1, wherein the opening/closing module is configured to be upwardly rotated about the hinge part so that the opening/closing module is positioned on an upper side of the housing to open the entrance of the deposit/withdrawal unit.

3. The automated teller machine of claim 1, wherein the deposit/withdrawal unit further includes a lifting module provided at the housing to move the tray unit inserted in the housing in a vertical direction.

* * * * *